US009038767B2

(12) United States Patent
Tsujino

(10) Patent No.: US 9,038,767 B2
(45) Date of Patent: May 26, 2015

(54) SOUND ABSORBING BODY AND PRINTING DEVICE

(71) Applicant: SEIKO EPSON CORPORATION, Tokyo (JP)

(72) Inventor: Kiyoshi Tsujino, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/177,413

(22) Filed: Feb. 11, 2014

(65) Prior Publication Data

US 2014/0224571 A1 Aug. 14, 2014

(30) Foreign Application Priority Data

Feb. 14, 2013 (JP) ..... 2013-026336

(51) Int. Cl.

| | |
|---|---|
| ***B41J 29/10*** | (2006.01) |
| ***E04B 1/84*** | (2006.01) |
| ***B41F 13/00*** | (2006.01) |
| *B41J 29/00* | (2006.01) |
| *E04B 1/74* | (2006.01) |

(52) U.S. Cl.
CPC ..... *B41F 13/0024* (2013.01)

(58) Field of Classification Search
USPC ..... 181/201, 200, 290, 286, 294
See application file for complete search history.

(56) References Cited

U.S. PATENT DOCUMENTS

| | | | | |
|---|---|---|---|---|
| 3,652,360 | A * | 3/1972 | Hartman et al. | 156/244.11 |
| 3,895,143 | A * | 7/1975 | Tarlow | 428/40.9 |
| 4,213,516 | A * | 7/1980 | Sulewsky | 181/286 |
| 4,214,646 | A * | 7/1980 | Planes et al. | 181/287 |
| 4,428,454 | A * | 1/1984 | Capaul et al. | 181/290 |
| 4,590,114 | A * | 5/1986 | Holtman | 428/171 |
| 4,828,932 | A * | 5/1989 | Morimoto et al. | 428/608 |
| 5,149,920 | A * | 9/1992 | Meeker et al. | 181/290 |
| 5,304,415 | A * | 4/1994 | Kurihara et al. | 428/328 |
| 5,684,278 | A * | 11/1997 | Yasukawa et al. | 181/286 |
| 5,834,711 | A * | 11/1998 | Haines | 181/290 |
| 5,965,851 | A * | 10/1999 | Herreman et al. | 181/200 |
| 6,789,646 | B2 * | 9/2004 | Wang et al. | 181/293 |
| 7,033,497 | B1 * | 4/2006 | Yamaguchi et al. | 210/315 |
| 7,070,848 | B2 * | 7/2006 | Campbell | 428/137 |
| 7,080,712 | B2 * | 7/2006 | Tsuiki et al. | 181/204 |
| 7,605,097 | B2 * | 10/2009 | Thompson et al. | 442/408 |
| 7,712,580 | B2 * | 5/2010 | Fuller et al. | 181/294 |
| 7,857,923 | B2 * | 12/2010 | Suda et al. | 156/62.2 |
| 8,051,950 | B2 * | 11/2011 | Alston | 181/294 |
| 8,118,177 | B2 * | 2/2012 | Drapela et al. | 210/504 |
| 8,256,572 | B2 * | 9/2012 | Castagnetti et al. | 181/290 |
| 8,496,088 | B2 * | 7/2013 | Kitchen et al. | 181/290 |
| 2004/0050619 | A1 * | 3/2004 | Bargo, II | 181/290 |
| 2011/0067348 | A1 * | 3/2011 | Giles et al. | 52/741.1 |
| 2011/0226547 | A1 * | 9/2011 | Kuhl et al. | 181/294 |
| 2014/0124291 | A1 * | 5/2014 | Dugan et al. | 181/290 |
| 2014/0224571 | A1 * | 8/2014 | Tsujino | 181/201 |
| 2014/0224572 | A1 * | 8/2014 | Tsujino | 181/201 |
| 2014/0224573 | A1 * | 8/2014 | Tsujino | 181/202 |

FOREIGN PATENT DOCUMENTS

| | | | |
|---|---|---|---|
| JP | 05-254214 | A | 10/1993 |

* cited by examiner

*Primary Examiner* — Edgardo San Martin
(74) *Attorney, Agent, or Firm* — Global IP Counselors, LLP

(57) ABSTRACT

A sound absorbing body includes a fibrillated part fibrillated into fiber form, and an unfibrillated part that is not fibrillated into fiber form. The unfibrillated part is dispersed inside the single sound absorbing body.

5 Claims, 2 Drawing Sheets

SOUND ABSORBING BODY AND PRINTING DEVICE

CROSS-REFERENCE TO RELATED APPLICATIONS

This application claims priority to Japanese Patent Application No 2013-026336 filed on Feb. 14, 2013. The entire disclosure of Japanese Patent Application No. 2013-026336 is hereby incorporated herein by reference.

BACKGROUND

1. Technical Field

The present invention relates to a sound absorbing body and a printing device.

2. Related Art

In the past, for example, with printers, items have been known for which a sound absorbing member for absorbing noise emanating from a printing head, platen and the like is equipped inside a case member (see Japanese Unexamined Patent Publication No. H05-254214, for example).

SUMMARY

However, since the density of the sound absorbing member noted above is almost uniform, it was necessary to make the thickness of the sound absorbing member even thicker to further increase the sound absorbing effect. Then, there was demand for a design that considered the thickness of the sound absorbing member when arranging the sound absorbing member inside an electronic device, and when the sound absorbing material became thicker, there was the problem that the external dimensions of electronic devices such as a printer and the like became larger.

The present invention was created to address at least a part of the problems described above, and can be realized as the modes or aspects below.

A sound absorbing body according to one aspect includes a fibrillated part fibrillated into fiber form, and an unfibrillated part that is not fibrillated into fiber form. The unfibrillated part is dispersed inside the single sound absorbing body.

With this constitution, the unfibrillated part exists dispersed inside the sound absorbing body. That unfibrillated part is not fibrillated, so sound does not enter easily. Because of this, when sound does enter the sound absorbing body, the sound passes through the fibrillated part while being randomly reflected in the unfibrillated part. Because of this, the distance the sound passes through the fibrillated part becomes longer. Then, in the process of passing through the fibrillated part, the sound is attenuated, so it is possible to increase the sound absorbing effect. Also, with a sound absorbing body of the same thickness, it is possible to obtain a greater sound absorbing effect by including the unfibrillated part and the fibrillated part, so it is possible to reduce the thickness of the sound absorbing body. Then, by doing this, for example, it is possible to make the external dimensions of the electronic device such as a printer and the like smaller.

With the sound absorbing body of the aspect noted above, when a perpendicular direction in relation to one surface of the sound absorbing body is used as a thickness direction, the unfibrillated part is preferably dispersed in a direction along the one surface and in the thickness direction.

With this constitution, the unfibrillated part is dispersed in the one surface direction and the thickness direction of the sound absorbing body, so when sound enters from any surface of the sound absorbing body, it is possible to absorb sound efficiently.

The unfibrillated part of the sound absorbing body of the aspect noted above includes cellulose fibers.

With this constitution, the unfibrillated part includes cellulose fibers, so it is possible to manufacture this easily using parts of pulp material that are not fibrillated, paper pieces, and the like.

A printing device according to another aspect is equipped with a case, a printing unit arranged inside the case, and the sound absorbing body noted above arranged inside the case.

With this constitution, for example, noise generated by the printing unit undergoes sound absorption by the sound absorbing body, so it is possible to provide a printing device with excellent sound absorbing properties. Also, the sound absorbing efficiency of the arranged sound absorbing body is high, so it is possible to inhibit the thickness of the sound absorbing body itself. By doing this, it is possible to make the printing device compact. In addition to printing devices, it is also possible to apply this to various types of electronic devices that require sound absorption.

BRIEF DESCRIPTION OF THE DRAWINGS

Referring now to the attached drawings which form a part of this original disclosure.

DETAILED DESCRIPTION OF EXEMPLARY EMBODIMENTS

Embodiments

Figure 1:
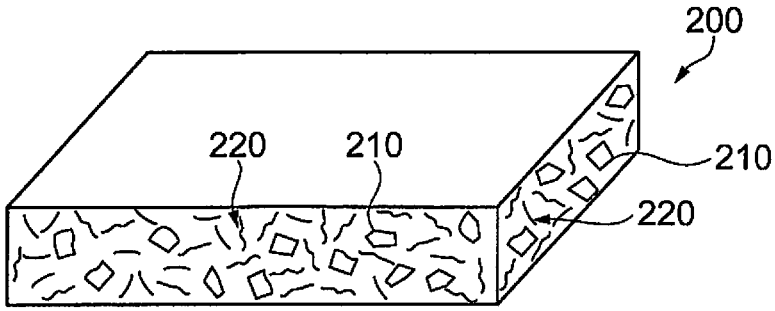
FIG. 1 is a pattern diagram showing the constitution of a sound absorbing body.

Following, we will describe embodiments of the present invention while referring to the drawings. In each drawing hereafter, to make each component and the like be a size of a level that is recognizable, the scale of each component and the like is shown different from actuality.

First, we will describe the constitution of the sound absorbing body. FIG. 1 is a pattern diagram showing the constitution of the sound absorbing body. The sound absorbing body 200 is an item that absorbs noise (does sound absorption) for electronic devices and the like, for example. As shown in FIG. 1, with one sound absorbing body 200, there is a fibrillated part 220 for which pulp material is fibrillated, and an unfibrillated part 210 for which pulp material is not fibrillated, and the unfibrillated part 210 is dispersed inside the one sound absorbing body 200. In more detail, when the perpendicular direction to one surface of the sound absorbing body is used as the thickness direction, the unfibrillated part 210 is dispersed in the direction along one surface and in the thickness direction. Specifically, the unfibrillated part 210 is dispersed in any of the directions of the sound absorbing body. The unfibrillated part 210 is paper pieces of approximately 2 to 4 mm square (or diameter), for example. Also, the unfibrillated part 210 is a part that has higher density than the fibrillated part 220. Therefore, the sound that has entered the sound absorbing body 200 is reflected (diffuse reflection) by the unfibrillated part 210, and by the reflected sound passing through the fibrillated part 220, it is possible to attenuate the sound and obtain a sound absorbing effect.

The sound absorbing body 200 is an item formed from a mixture including cellulose fiber, molten resin, and flame retardant. The cellulose fiber is an item for which a pulp sheet and the like as the pulp material is fibrillated into fiber form using a dry type defibrating machine such as a rotary crushing device, for example. Then, mixed in with this fibrillated fiber group is the unfibrillated part 210 that has not been fibrillated into fiber form (e.g. paper pieces).

The molten resin is an item that binds between cellulose fibers, gives suitable strength (hardness and the like) to the sound absorbing body 200, prevents paper powder and fiber from scattering, and contributes to maintaining the shape of the sound absorbing body 200. For the molten resin, it is possible to use various modes such as fiber form, powder form and the like. Then, by heating the mixture with cellulose fiber and molten resin mixed, it is possible to melt the molten resin, and to fuse the cellulose fibers and harden them. It is preferable to fuse at a temperature of a level that will not cause thermal degradation of the cellulose fibers and the like. Also, it is preferable that the molten resin be in a fiber form that easily entwines with paper fibers in the fibrillated material. Furthermore, it is preferable to use a core-sheath structure conjugated fiber. With the core-sheath structure molten resin, the surrounding sheath part melts at a low temperature, and by the fiber form core part bonding with the molten resin itself or with the cellulose fiber, it is possible to make a strong bond.

The flame retardant is an item added to give flame resistance to the sound absorbing body 200. As the flame retardant, for example, it is possible to use inorganic materials such as aluminum hydroxide, magnesium hydroxide and the like, or phosphorous based organic materials (e.g. aromatic phosphate such as triphenylphosphate and the like).

As the sound absorbing body 200 forming method, for example, a mixture for which cellulose fiber, molten resin, and flame retardant are mixed are placed in a sieve, and this is deposited on a mesh belt arranged beneath the sieve to form a deposit. Then, the formed deposited substance undergoes pressurization heat treatment. By doing this, the molten resin is melted, and this is formed to a desired thickness. Furthermore, by die cutting to a desired dimension, the sound absorbing body 200 is formed.

It is also possible to laminate a plurality of sound absorbing bodies 200. By doing this, it is possible to further increase the sound absorbing effect.

Figure 2:
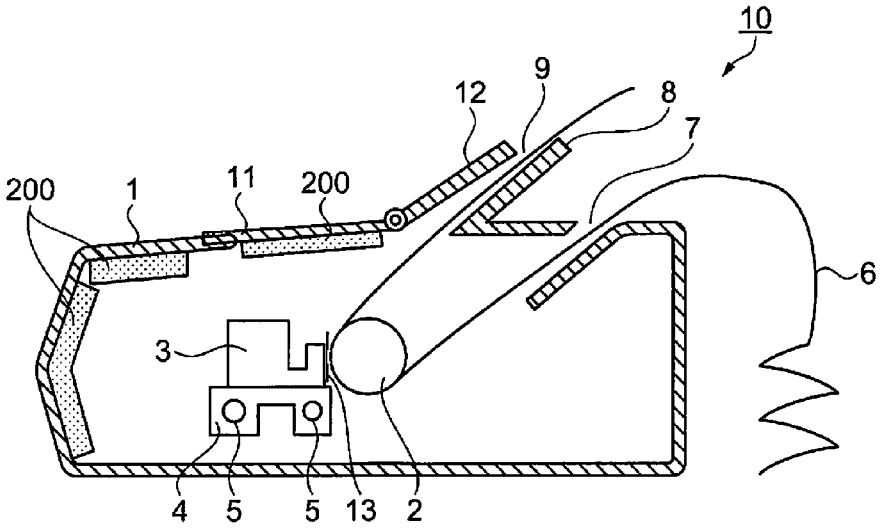
FIG. 2 is a schematic diagram showing the constitution of the printer.

Next, we will describe the constitution of the printing device. With this embodiment, we will describe the constitution of a printer as the printing device. FIG. 2 is a cross section diagram showing the constitution of the printer. As shown in FIG. 2, the printer 10 of this embodiment is equipped with a case 1, a printing head 3 as the printing unit arranged inside the case 1, a sound absorbing body 200 arranged inside the case 1 and the like. This printer 10 performs printing by giving an impact using a printing wire (not illustrated) provided inside the printing head 3 via an ink ribbon 13 on printing paper 6 as a printing medium arranged between a platen 2 and the printing head 3.

The printing paper 6 is fed from the paper feeding port 7 provided in the case 1 of the printer 10 and wound on the platen 2, printing is performed by the printing head 3 (in addition to numbers, letters and the like, this is a broad concept also including printing graphs using dots and the like), and the paper is ejected from a paper ejection port 9. A carriage 4 can be guided by a guide shaft 5 and moved in the axial direction. The ink ribbon 13 is interposed between the printing head 3 and the printing paper 6, and the printing head 3 fixed to the carriage 4 performs printing by driving a plurality of printing wires provided inside the printing head 3 at a desired timing while moving in the axial direction.

A freely openable/closable cover 11 and a paper ejection port cover 12 are attached to the case 1, and the paper ejection port cover 12 is rotatably connected to the cover 11. Also, the paper ejection port cover 12 is constituted with a transparent, light member, so the printing paper 6 is easy to see, and it is easy to take it out. Then, the printed printing paper 6 is ejected from the paper ejection port 9 along a paper guide 8.

Also, the printer 10 is equipped with the sound absorbing body 200 that absorbs noise (does sound absorption). The constitution of the sound absorbing body 200 is the same as the constitution in FIG. 1, so we will omit a description. With this embodiment, the sound absorbing body 200 is arranged at the part corresponding to the periphery of the printing head 3 of the case 1. In specific terms, it is arranged at the part corresponding to the side opposite to the drive part of the printing head 3 of the case 1. Furthermore, the sound absorbing body 200 is also arranged on the cover 11 corresponding to above the printing head 3. By doing this, when noise occurs with driving of the printing head 3, the generated noise enters the sound absorbing body 200, and while the sound is being reflected by the unfibrillated part 210, the reflected sound is propagated by the fibrillated part 220, so in that process, the sound is effectively absorbed, and it is possible to prevent the diffusion of noise inside the case 1.

With this embodiment, we described an example of a printer as the printing device, but the invention is not limited to this, and it is also possible to apply this to various types of electronic devices that require sound absorption.

As described above, with this embodiment, the following effects can be obtained.

(1) The sound absorbing body 200 includes the fibrillated part 220 and the unfibrillated part 210, and when sound enters the sound absorbing body 200, while sound is reflected with the higher density unfibrillated part 210, the sound passes through the lower density fibrillated part 220 while being propagated, and is attenuated. By doing this, it is possible to increase the sound absorption effect.

(2) With the printer 10 equipped with the sound absorbing body 200 noted above, it is possible to efficiently reduce noise during driving of the printing head 3.

EXAMPLES

Next, we will describe specific examples of the present invention.

1. Mixture

(1) Cellulose Fiber

A pulp sheet cut into several cm using a cutting machine was fibrillated into floc using a turbo mill (made by Turbo Kogyo Co., Ltd.).

(2) Molten Resin

This is polyethylene having a core-sheath structure, with the sheath melted at 100° C. or greater, and the core being 1.7 dtex molten fiber consisting of polyester (Tetoron, made by Teijin, Ltd.).

(3) Flame Retardant

Aluminum hydroxide B53 (made by Nippon Light Metal Co., Ltd.)

2. Formation of the Sound Absorbing Body

Example 1

Formation of the Sound Absorbing Body A

A mixture C1 for which 100 weight parts of cellulose fiber, 15 weight parts of molten fiber, and 10 weight parts of flame retardant were air mixed was passed through a 10 mm opening size sieve and deposited on a mesh belt. At this time, depositing on the mesh belt was done while suctioning using a suction device. Then, the deposited deposit substance underwent pressurization heat treatment at 200° C. After that, this was cut to Ø 29 mm and 10 mm thick to form sound absorbing body A. When the density of that sound absorbing body A was observed, a fibrillated part for which the pulp sheet was fibrillated and an unfibrillated part for which the pulp sheet was not fibrillated were formed.

Example 2

Formation of the Sound Absorbing Body B

A mixture C2' for which 100 weight parts of cellulose fiber, 15 weight parts of molten fiber, and 10 weight parts of flame retardant were air mixed was passed through a 3 mm opening size sieve, and a mixture C2 that passed through that sieve was formed. Also, when the mixture C2' was passed through the 3 mm opening size sieve, the mixture that did not pass through the sieve (remained in the sieve) was mixed into the mixture C1 noted above to form a mixture C3. Therefore, the mixture C3 is a mixture with a high content rate of the unfibrillated part. Meanwhile, the mixture C2 is a mixture with a low content rate of the unfibrillated part. Then, the mixture C2 and the mixture C3 were alternately deposited on the mesh belt. With example 2, the mixture C2 and the mixture C3 were alternately deposited six times each. Then, the deposited deposit material underwent pressurization heat treatment at 200° C. After that, this was cut to Ø 29 mm and 10 mm thick to form sound absorbing body B. When the density of that sound absorbing body B was observed, a layer with a high content rate of the unfibrillated part and a layer with a low content rate of the unfibrillated part were formed.

Comparison Example 1

Formation of the Sound Absorbing Body R

A mixture C2' for which 100 weight parts of cellulose fiber, 15 weight parts of molten fiber, and 10 weight parts of flame retardant were air mixed was passed through a 3 mm opening size sieve, and a mixture C2 that passed through that sieve was formed. Then, the mixture C2 was deposited on the mesh belt. Then, the deposited deposit material underwent pressurization heat treatment at 200° C. After that, this was cut to Ø 29 mm and 10 mm thick to form sound absorbing body R. When the density of that sound absorbing body R was observed, a layer with a low content rate of the unfibrillated part was formed.

3. Evaluation

Next, an evaluation of the sound absorbing properties is performed for the example 1, the example 2, and the comparison example 1 noted above. This sound absorbing property evaluation measures the sound absorption rate (normal incident sound absorption rate) based on JIS A 1405-2. Specific details are as noted below.

(a) Sound Absorption Property Evaluation Method

Figure 3:
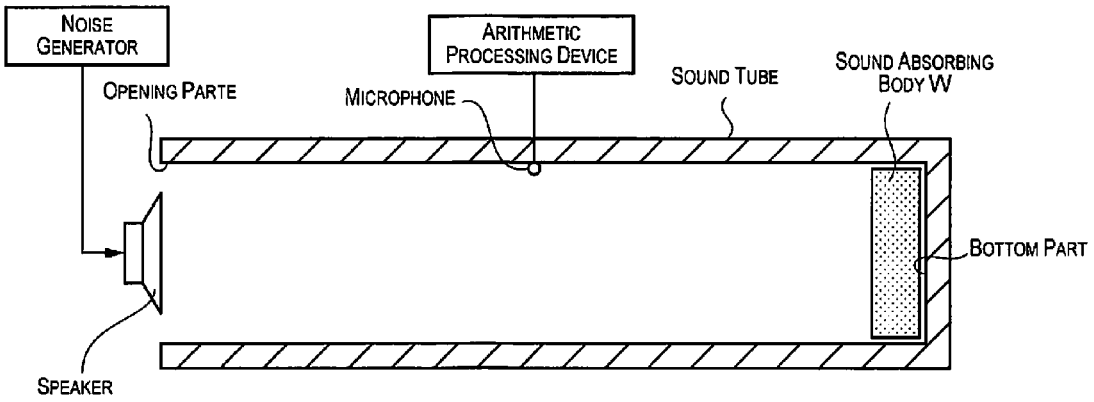
FIG. 3 is a pattern diagram showing the evaluation method of the sound absorbing properties of the sound absorbing body.

FIG. 3 is a pattern diagram showing the method for evaluating the sound absorption properties. As shown in FIG. 3, the equipment for evaluating the sound absorbing properties includes a sound tube, a bottom part provided at one end part of the sound tube, an opening part opened at the other end part of the sound tube, a microphone arranged inside the sound tube, a speaker arranged in the opening part of the sound tube, a noise generator connected to the speaker, and an arithmetic processing device and the like.

After the sound absorbing body W is set in the bottom part of the sound tube, sound of a designated frequency is radiated from the speaker, and a sound field is generated inside the sound tube. Then, the normal incident sound absorption rate is calculated based on the sound pressure signal obtained from the microphone inside the sound tube. By this evaluation, it is possible to evaluate the sound absorbing effect of the sound absorbing body W.

(b) Radiated Sound Frequency (b-1) 1000 Hz
(b-2) 2000 Hz
(b-3) 4000 Hz

Sound absorption was evaluated for example 1 and example 2 and comparison example 1 noted above. The evaluation results are shown in table 1. With table 1, the sound absorption rate for each frequency of example 1 and example 2 is expressed when the sound absorption rate of the comparison example 1 is set as 1. Therefore, when the number is higher than the sound absorption rate 1 with the comparison example 1, the evaluation is that there is a greater sound absorption effect. Meanwhile, when the number is smaller than the absorption rate 1 with the comparison example 1, the evaluation is that there is a low sound absorption effect.

TABLE 1

| | 1000 Hz | 2000 Hz | 4000 Hz |
|---|---|---|---|
| Example 1 | 1.06 | 1.28 | 1.19 |
| Example 2 | 1.62 | 1.50 | 1.19 |
| Comparison Example 1 | 1 | 1 | 1 |

As shown in table 1, with example 1 and example 2, the sound absorption rate for all frequency areas corresponding to all the examples is a numerical value greater than the absorption rate with the comparison example 1, and the effect was of having excellent sound absorbing properties. This is because the unfibrillated part is dispersed inside the sound absorbing body A and the sound absorbing body B of example 1 and example 2, and because the entered sound is propagated to the fibrillated part while being reflected on the unfibrillated part.

The fibrillated part and the unfibrillated part which are the feature points of this application have paper pieces mixed in a fiber agglomeration having air gaps, and this can be understood visually by the external appearance or by confirming using a stereo microscope. When the paper pieces are not exposed at the surface, this can be understood by cutting the sound absorbing body into a plurality of pieces, and by the paper pieces being exposed at the cut surface.

With the embodiments noted above, to prevent fuzz on the surface of the sound absorbing body 200 and the like, it is possible to adhere a thin non-woven cloth to the surface. Since adhered non-woven cloth is thinner than the sound absorbing body 200, there is little effect on the sound absorbing properties.

With the embodiments noted above, the sound absorbing body 200 was a rectangular solid, but the invention is not limited to this. It is also possible to have a notch or recess in a portion of the rectangular solid, or to have a circular arc part or a sloped part rather than a rectangular solid.

With the embodiments noted above, the pulp sheet includes wood pulp such as of conifer trees, broad leafed trees and the like, non-wood plant fibers such as of hemp, cotton, kenaf and the like, and used paper and the like.

With the embodiments noted above, cellulose fiber was the main constituent, but as long as it is a material that absorbs sound, and can be given density differences, this is not limited to cellulose fiber. It is also possible to use fiber with a raw material of a plastic such as polyurethane or polyethylene terephthalate (PET) and the like, or another fiber such as wool and the like.

The method for forming the sound absorbing body is not limited to the method noted with the embodiments noted above. As long as the features of this application can be presented, another manufacturing method such as a wet method and the like can also be used.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A sound absorbing body comprising:

a fibrillated part fibrillated into fiber form and included in a fiber group into which a pulp sheet is defibrated at a defibrating machine; and an unfibrillated part that is not fibrillated into fiber form and is included in the fiber group, the unfibrillated part being dispersed inside the single sound absorbing body.

2. The sound absorbing body according to claim 1, wherein when a perpendicular direction in relation to one surface of the sound absorbing body is used as a thickness direction, the unfibrillated part is dispersed in a direction along the one surface and in the thickness direction.

3. The sound absorbing body according to claim 1, wherein the unfibrillated part includes cellulose fibers.

4. A printing device comprising:

a case;

a printing unit arranged inside the case; and the sound absorbing body according to claim 1, arranged inside the case.

5. The sound absorbing body according to claim 1, wherein the unfibrillated part has a plurality of paper-shaped pieces.

* * * * *